US005591569A

United States Patent [19]

Kapp et al.

[11] Patent Number: 5,591,569

[45] Date of Patent: Jan. 7, 1997

[54] PHOTOGRAPHIC ELEMENT CONTAINING AN AZOPYRAZOLONE MASKING COUPLER EXHIBITING IMPROVED KEEPING

[75] Inventors: Daniel L. Kapp; Janet Younathan, both of Rochester, N.Y.

[73] Assignee: Eastman Kodak Company, Rochester, N.Y.

[21] Appl. No.: 539,560

[22] Filed: Oct. 5, 1995

Related U.S. Application Data

[63] Continuation of Ser. No. 130,035, Sep. 30, 1993, abandoned.

[51] Int. Cl.[6] ..... G03C 7/333; G03C 7/38; G03C 7/392

[52] U.S. Cl. ..... 430/549; 430/551; 430/555; 430/558

[58] Field of Search ..... 430/558, 549, 430/551, 555

[56] References Cited

U.S. PATENT DOCUMENTS

| | | | |
|---|---|---|---|
| 4,977,072 | 12/1990 | Renner et al. | 430/549 |
| 5,006,454 | 4/1991 | Sasaki et al. | 430/551 |
| 5,068,172 | 11/1991 | Seto et al. | 430/551 |
| 5,219,719 | 6/1993 | Kida | 430/549 |
| 5,270,156 | 12/1995 | Hirabayashi | 430/505 |

FOREIGN PATENT DOCUMENTS

| | | | |
|---|---|---|---|
| 0232101 | 8/1987 | European Pat. Off. | 430/549 |
| 536889 | 4/1993 | European Pat. Off. . | |
| 556700 | 8/1993 | European Pat. Off. . | |
| 3913404 | 10/1990 | Germany . | |
| 3095448 | 4/1988 | Japan | 430/551 |
| 3095449 | 4/1988 | Japan | 430/551 |

*Primary Examiner*—Lee C. Wright
*Attorney, Agent, or Firm*—Arthur E. Kluegel

[57] ABSTRACT

This invention provides a photographic process and element where the element comprises a support bearing a light-sensitive photographic silver halide layer containing (1) a bicyclic azole coupler, (2) an azopyrazolone masking coupler, and (3) an aromatic electron-rich compound having ring substituents for which the sum of the individual Hammett sigma-para values is more negative than −0.80.

34 Claims, No Drawings

PHOTOGRAPHIC ELEMENT CONTAINING AN AZOPYRAZOLONE MASKING COUPLER EXHIBITING IMPROVED KEEPING

This is a Continuation of application Ser. No. 08/130,035, filed 30 Sep. 1993, now abandoned.

FIELD OF THE INVENTION

This invention relates to photographic elements containing a bicyclic azole coupler and an azopyrazolone masking coupler used to correct for unwanted absorption in color negative film. More particularly, it relates to such elements containing an electron-rich aromatic compound having substituents the sum of the individual Hammett sigma-para values of which is at least as negative as –0.80.

BACKGROUND OF THE INVENTION

The use of 4-phenylazopyrazolone masking couplers is known in the art. See, for example, U.S. Pat. No. 2,428,034; U.S. Pat. No. 2,434,272; U.S. Pat. No. 2,455,170; U.S. Pat. No. 2,688,539; U.S. Pat. No. 2,704,711; U.S. Pat. No. 2,808,329; U.S. Pat. No. 3,476,560; U.S. Pat. No. 3,796,574; U.S. Pat. No. 4,427,763; U.S. Pat. No. 4,777,123, and EP 213,490; as well as those identified in *Research Disclosure* December 1989, Section VII, Part G, Publiched by Kenneth Mason Publications, Ltd., Dudley Annex, 12A North Street, Emworth, Hampshire PO10 7DQ, England. These compounds have proven useful since they are yellow colored in nonexposed areas and magenta colored in exposed areas. Thus, when in reality the magenta dye formed in a color negative photographic process has a small but significant unwanted absorption in the blue range, this may be balanced somewhat by the relative loss of blue absorption due to conversion of the mask color from yellow to magenta in the exposed areas. Then, an adjustment can be made to the spectral content of the light used to produce the positive from the negative to effectively cancel out the unwanted blue absorption, which is now relatively constant across both the exposed and unexposed areas of the negative.

While phenylazopyrazolone masking couplers have been employed as a means of offsetting the unwanted blue absorption of conventional magenta couplers, this means for improving the color rendition has now been found to be responsible for the degradation during raw stock keeping of bicyclic azole image couplers with corresponding losses in contrast, optical density and related photographic characteristics. The presence of these masking couplers results in the degradation and loss of image coupler. This is thought to be due to an undesired reaction in the raw stock prior to development between the masking coupler and undesired oxidants. The unwanted degradation of the image coupler eventually results in the loss of density in the photographic image. It is undesirable to have a film where the image density will vary with the length of raw stock storage time.

European Patent Application 232,101 discloses a photographic element containing a pyrazolotriazole coupler together with at least 17 mole % of a colored masking coupler which may be of the azopyrazolone type. The presence of the large relative percentage of the masking coupler is said to improve sharpness and grain. There is no suggestion of the advantages to be obtained by including an aromatic electron-rich compound and, in fact, the higher concentration of masking coupler suggested would serve to aggravate the raw stock keeping problems. U.S. Pat. No. 4,777,123 contains a similar general disclosure but again does not suggest the advantage of using the aromatic electron-rich compound. U.S. Pat. No. 4,600,688 proposes broad combinations of pyrazolotriazoles and pyrazolones as having an advantageous color absorption spectrum. Specific combinations of a bicyclic azole coupler, an azopyrazolone masking coupler and an aromatic electron-rich compound are not suggested nor is the resultant advantage in raw stock keeping recognized.

It would be desirable to provide a photographic element and process where an azopyrazolone masking coupler can be used in combination with a bicyclic azole image coupler without incurring degradation of the image coupler during raw stock keeping.

SUMMARY OF THE INVENTION

The invention provides a photographic element comprising a light sensitive silver halide layer containing (1) a bicyclic azole coupler, (2) an azopyrazolone masking coupler, and (3) an aromatic electron-rich compound having ring substituents for which the sum of the individual Hammett sigma-para values is more negative than –0.80. This invention also provides photographic materials and processes for obtaining images related to these elements.

The advantage of the element is that it exhibits improved raw stock keeping thus providing greater contrast and image density.

DETAILED DESCRIPTION OF THE INVENTION

The bicyclic azole compound of the invention contains at least two rings. Typically, the compound is a pyrazole or imidazole compound and may be represented by one of the formulas:

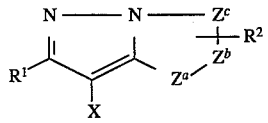

IA or

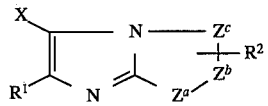

IB where the variables are as defined below.

An embodiment of the invention is a photographic element comprising a support bearing at least one photographic silver halide emulsion layer containing a dye-forming bicyclic azole coupler wherein the dye-forming coupler is represented by one of the formulas:

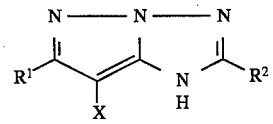

IIA

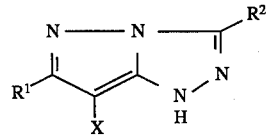

IIB

-continued

IIC

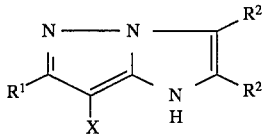

IID

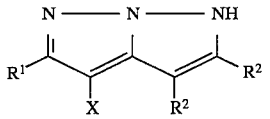

IIE

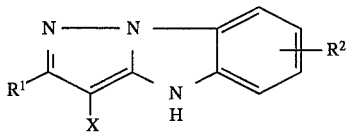

IIF

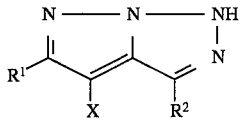

IIG

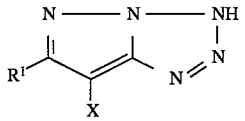

IIH

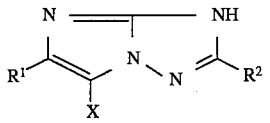

wherein $R^1$ and each $R^2$ are independently hydrogen or substituents that do not adversely affect the coupling action of the coupler;

X is hydrogen or a coupling-off group known in the photographic art; and $Z^a$, $Z^b$ and $Z^c$ are independently selected from the group consisting of a substituted or unsubstituted methine group, =N—, =C< or —NH—, provided that one of either the $Z^a$—$Z^b$ bond or the $Z^b$—$Z^c$ bond is a double bond and the other is a single bond, and when the $Z^b$—$Z^c$ bond is a carbon-carbon double bond, it may form part of an aromatic ring.

As used herein, the term substituent, both for $R^1$ and $R^2$ and elsewhere unless otherwise specifically stated, has a broad definition. The substituent may be, for example, halogen, such as chlorine, bromine or fluorine; nitro; hydroxyl; cyano; and —$CO_2H$ and its salts; and groups that may be further substituted, such as alkyl, including straight or branched chain alkyl, such as methyl, trifluoromethyl, ethyl, t-butyl, 3-(2,4-di-t-amylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, α- or β-naphthyloxy, and 4-tolyloxy; carbonamido, such as acetamido, benzamido, butyramido, tetradecanamido, α-(2,4-di-t-pentylphenoxy)acetamido, α-(2,4-di-t-pentylphenoxy)butyramido, α-(3-pentadecylphenoxy)hexanamido, α-(4-hydroxy-3-t-butylphenoxy)tetradecanamido, 2-oxo-pyrrolidin-1-yl, 2-oxo-5-tetradecyl-pyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylcarbonylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, and hexadecylsulfonamido; sulfamoyl, such as N-methylsulfamoyl, N,N-dipropylsulfamoylamino, N-ethylsulfamoyl, N,N-dipropylsulfamoyl, N-hexadecylsulfamoyl, N,N-dimethylsulfamoyl; N-[3-(dodecyloxy)propyl] sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 42 carbon atoms and typically less than 30 carbon atoms, but greater numbers are possible depending on the particular substituents selected. Moreover, as indicated, the substituents may themselves be suitably substituted with any of the above groups.

The bicyclic azole coupler contains in the coupling position, represented by X, either hydrogen or a coupling-off group.

Coupling-off groups are known to those skilled in the art. Such groups can determine the equivalency of the coupler, can modify the reactivity of the coupler, or can advantageously affect the layer in which the coupler is coated or other layers in the element by performing, after release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acytoxy, carbonamido, imido, acyl, heterocyclylimido, thiocyano, alkylthio, arylthio, heterocyclylthio, sulfonamido, phosphonyloxy and arylazo. They are described in, for example, U.S. Pat. Nos. 2,355,169; 3,227,551; 3,432,521; 3,476,563; 3,617,291; 3,880,661; 4,052,212 and 4,134,766; and in U.K. patents and published application numbers 1,466,728; 1,531,927; 1,533,039; 2,006,755A 2,017,704A; and in EP 285,274.

Examples of specific coupling-off groups are Cl, F, Br, —SCN, —$OCH_3$, —$OC_6H_5$, —$OCH_2C(=O)NHCH_2CH_2OH$, —$OCH_2C(=O)NHCH_2CH_2OCH_3$, —$OCH_2C(=O)NHCH_2CH_2OC(=O)OCH_3$, —$NHSO_2CH_3$, —$OC(=O)C_6H_5$, —$NHC(=O)C_6H_5$, $OSO_2CH_3$, —$P(=O)(OC_2H_5)_2$, —$S(CH_2)_2CO_2H$,

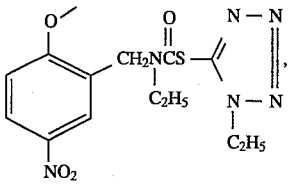

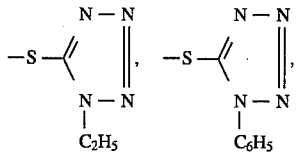

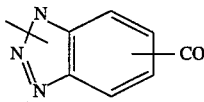

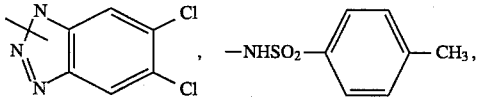

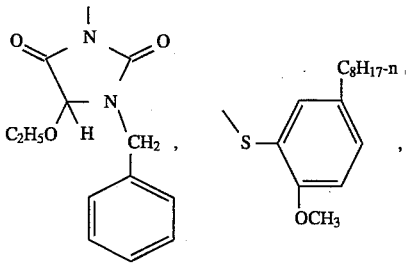

-continued

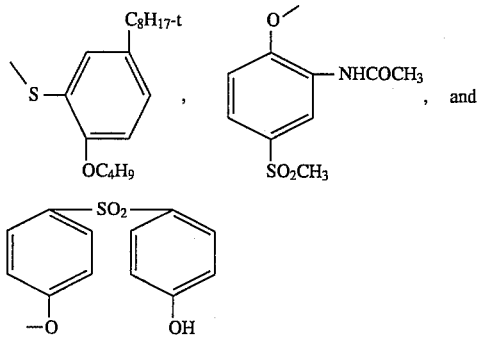

Suitably, the coupling-off group is H or halogen, and more specifically, H or Cl. Suitably, $R^1$ and $R^2$ together contain from 8 to 50 carbon atoms or more and typically 12 to 42 carbon atoms.

Generally, either $R^1$ or $R^2$ contains a ballast group where the ballast group is an organic radical of such size and configuration as to confer on the coupler molecule sufficient bulk to render the coupler substantially non-diffusible from the layer in which it is coated in a photographic element. Thus, the combination of groups $R^1$ and $R^2$ from the formula are chosen to meet this criteria as can be determined by one skilled in the art.

Typical pyrazolo-[3,2-c]-1,2,4-triazole magenta image dye-forming couplers within the described structure are disclosed in, for example, U.S. Pat. Nos. 4,443,536; 4,777,121; 4,808,502; 4,835,094; 4,960,685; and 5,019,489; and European Patents 284,240 and 285,274.

Typical pyrazolo-[1,5-b]-1,2,4-triazole couplers are described in, for example, U.S. Pat. Nos. 4,540,654; 4,659,652; 4,774,172; 4,822,730; and 4,925,781; Japanese Published Patent Application No. 61-147254; and European Patents 119,860; 226,849; 234,428; and 294,785.

Typical bicyclic imidazole compounds are exemplified in PCT patent publication WO 92/12464.

Specific examples of couplers useful in the element of the invention are

M-1
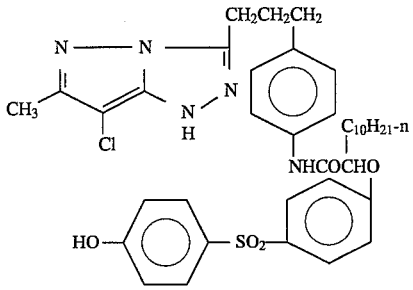
M-2
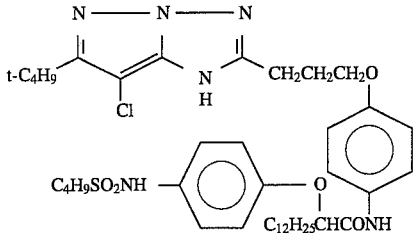
M-3
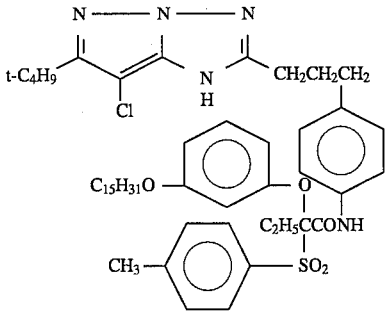
M-4
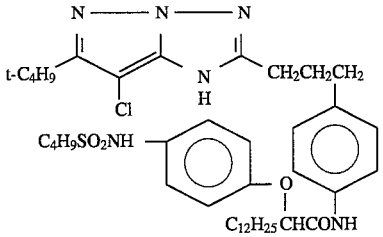
M-5
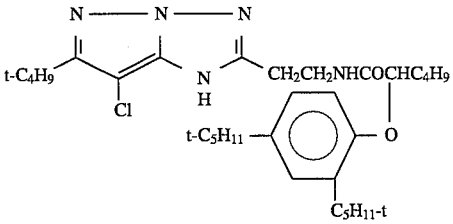
M-6
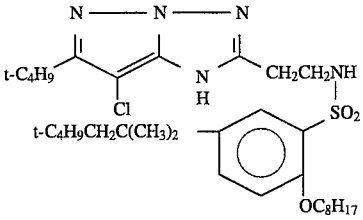
M-7
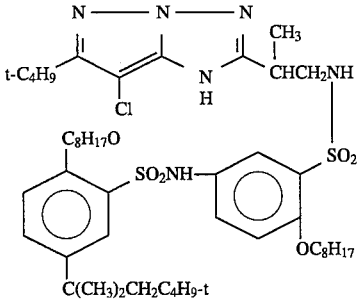
M-8
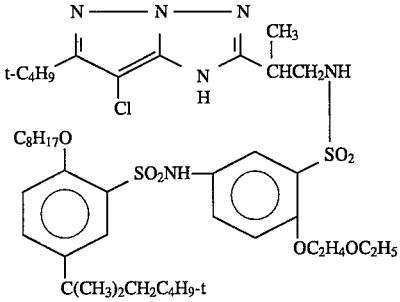
M-9
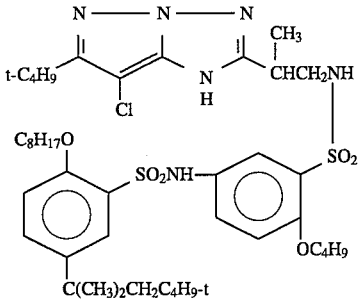
M-10
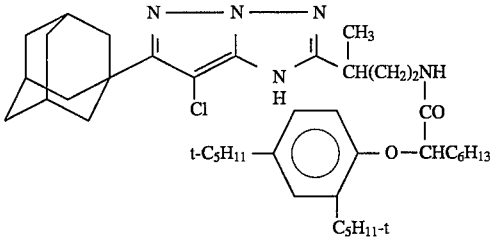

-continued
M-11
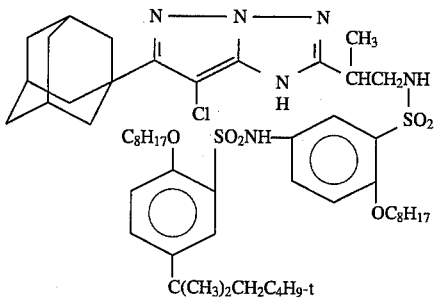
M-12
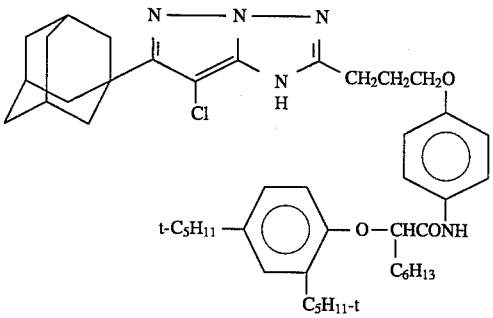
M-13
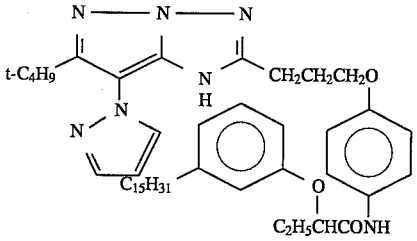
M-14
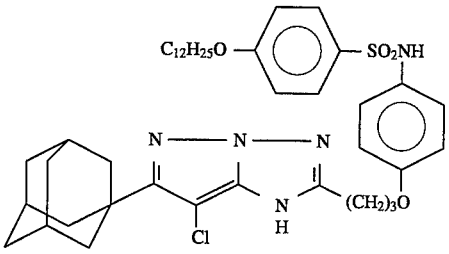
M-15
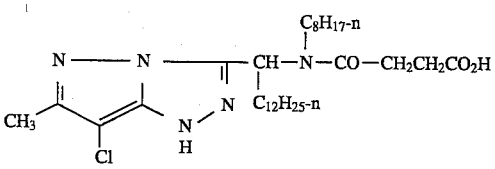
M-16
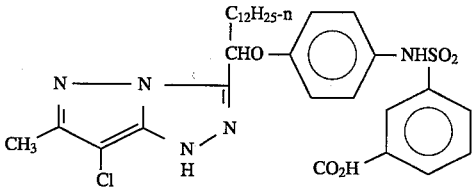
M-17
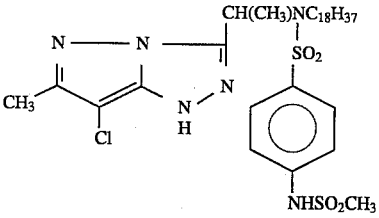
M-18
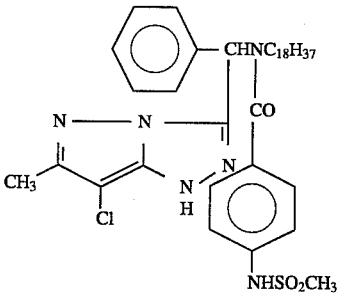
M-19
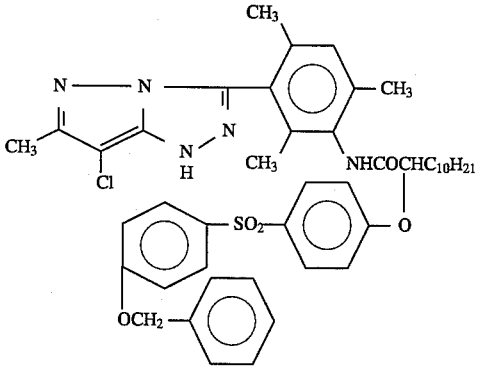
M-20
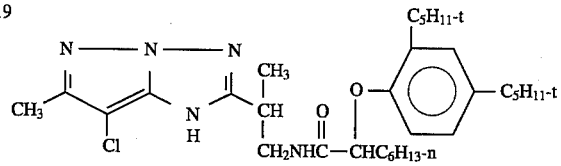

-continued

M-21

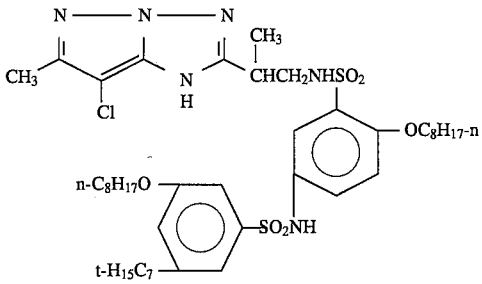

M-22

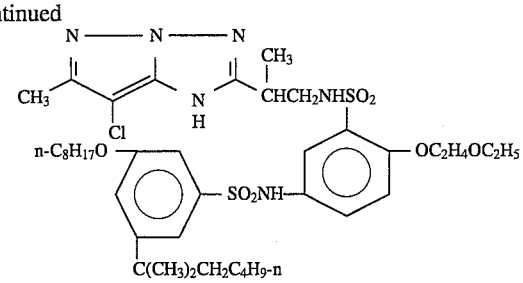

M-23

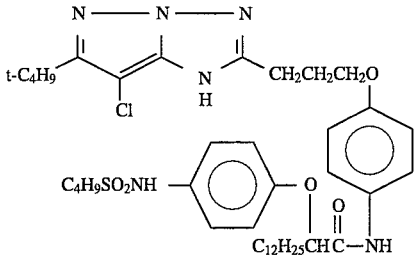

M-24

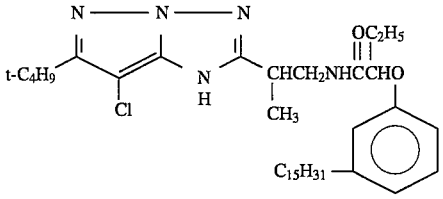

M-25

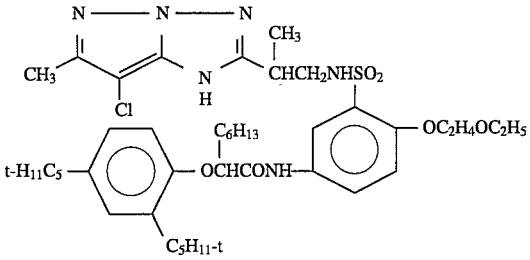

M-26

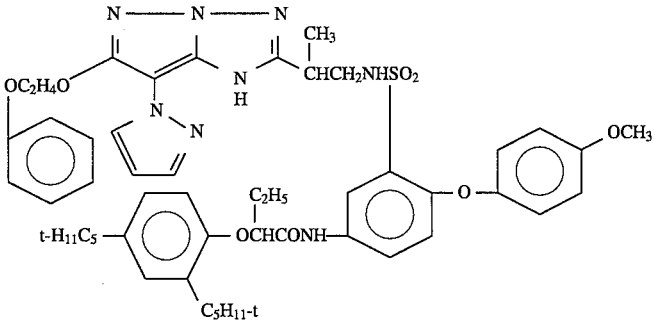

M-27

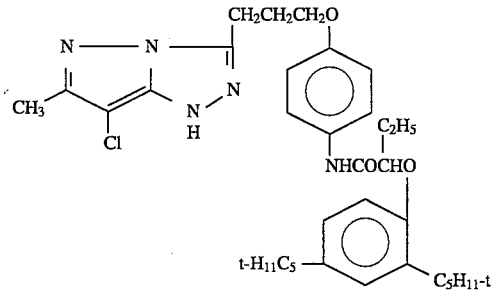

M-28

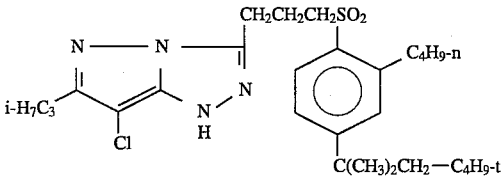

M-29

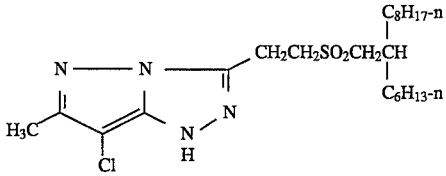

M-30

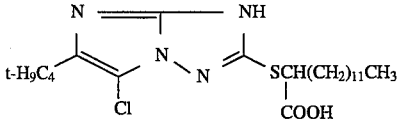

The azopyrazolone masking coupler of the invention can be any such compound which is either colorless or is yellow or cyan and which in any event provides a magenta color in response to green exposure upon development. If desired, it may be a so-called shifted masking coupler where the color in the unexposed areas is not evident until processing. The general structure of such materials is shown in the following formula:

$$Cp—N=N—R_3$$

In the formula, Cp represents a 5-pyrazolone magenta coupler residual group (provided, however, that the azo group is attached to the active site of the magenta coupler at the 4-position), and $R_3$ represents an aryl group (including the group having a substituent).

The magenta coupler residual group represented by Cp suitably has the formula:

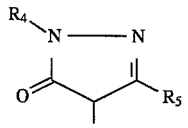

In the formula, $R_4$ represents a substituted or unsubstituted aryl group; $R_5$ represents a substituted or unsubstituted acylamino group, anilino group, amino group, alkyl group, ureido group or carbamoyl group. $R^4$ and $R^5$ typically contain 1 to 42 carbon atoms.

The aryl group represented by $R_4$ is typically a phenyl group. The substituents for the aryl group represented by $R_4$ may include, for example, a halogen atom (for example, fluorine, chlorine, bromine, etc.), an alkyl group (for example, methyl, ethyl, etc.), an alkoxy group (for example, methoxy, ethoxy, etc.), an aryloxy group (for example, phenyloxy, naphthyloxy, etc.), an acylamino group (for example, benzamide, α-(2,4-di-t-amylphenoxy)-butylamide, etc.), a sulfonylamino group (for example, benzenesulfonamide, n-hexadecansulfonamide, etc.), a sulfamoyl group (for example, methylsulfamoyl, phenylsulfamoyl, etc.), a carbamoyl group (for example, an n-butylcarbamoyl group, a phenyl carbamoyl group, etc.), a sulfonyl group (for example, methylsulfonyl, n-dodecylsulfonyl, benzenesulfonyl, etc.), an acyloxy group, an ester group, a carboxyl group, a sulfo group, a cyano group, a nitro group, a trifluoro group, etc.

Specific examples of $R_4$ are phenyl, 2,4,6-trichlorophenyl, pentachlorophenyl, pentafluorophenyl, 2,4-6-trimethylphenyl, 2-chloro-4,6-dimethylphenyl, 2,6-dichloro-4-methylphenyl, 2,4-dichloro-6-methylphenyl, 2,4-dichloro-6-methoxyphenyl, 2,6-dichloro-4-methoxyphenyl, 2,6-dichloro-4-[α-(2,4-di-t-amylphenoxy)acetamide]phenyl, 2,6-dichloro-4-dodecysulfonylphenyl, 2,6-dichloro-4-(N-dodecyl)sulfamoylphenyl, 2,4-dichloro-6-trifluoromethylphenyl, etc.

The acylamino group represented by $R_5$ may include, for example, pivaloylamido, n-tetradecanamido, α-(3-pentadecylphenoxy)butylamido, 3-[α-(2,4-di-t-amylphenoxy)acetamido]benzamido, benzamido, 3-acetoamidobenzamido, 3-(3-n-dodecylsuccinimide)benzamido, 3-(4-n-dodecyloxybenzenesulfonamide)benzamido, etc.

The anilino group represented by $R_5$ may include, for example, anilino, 2-chloroanilino, 2,4-dichloroanilino, 2,4-dichloro-5-methoxyanilino, 4-cyanoanilino, 2-chloro-5-[α-(2,4-di-t-amylphenoxy)butylamido]anilino, 2-chloro-5-(3-octadecenylsuccinimide)anilino, 2-chloro-5-n-tetradecanamidoanilino, 2-chloro-5-[α-(3-t-butyl-4-hydroxyphenoxy)tetradecanamido]anilino, 2-chloro-5-n-hexadecansulfoamidoanilino, 2-chloro-4-n-dodecanylsulfonylanilino, 2-chloro-4-n-dodecanylsulfonamidoanilino, etc.

The alkyl group represented by $R_5$ may include, for example, methyl, ethyl, dodecyl, t-butyl, s-butyl, etc.

The amino group represented by $R_5$ may include, for example, N-methylamino, N,N-dimethylamino, N-dodecylamino, pyrrolidino, etc.

The ureido group represented by $R_5$ may include, for example, methylureido, phenylureido, 3-[α-(2,4-di-t-amylphenoxy)butylamido]phenylureido, etc.

The carbamoyl group represented by $R_5$ may include, for example, n-tetradecylcarbamoyl, phenylcarbamoyl, 3-[α-(2,4-di-t-amylphenoxy)acetamide]carbamoyl, etc.

The aryl group represented by $R_3$ is preferably a phenyl group or a naphthyl group.

Substituents for the aryl group $R_3$ may include, for example, a halogen atom, an alkyl group, an alkoxy group, an aryloxy group, a hydroxyl group, an acyloxy group, a carboxyl group, an alkoxycarbonyl group, an aryloxycarbonyl group, an alkylthio group, an arylthio group, an alkylsulfonyl group, an arylsulfonyl group, an acyl group, a sulfonamide group, a carbamoyl group, a sulfamoyl group, etc. There may be any combination of these substituents and there may be up to 5 substituents on a phenyl ring and 7 for a napthyl group.

Particularly suitable substituents include an alkyl group, a hydroxyl group, an alkoxy group and an acylamino group.

Examples of the colored magenta couplers represented by the formula are shown below, but are by no means limited to these.

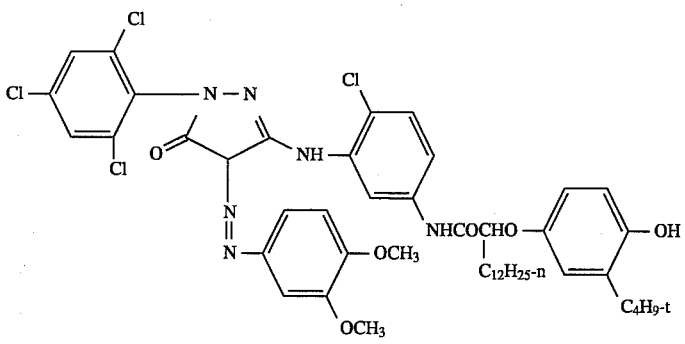

MC-1

-continued
MC-2
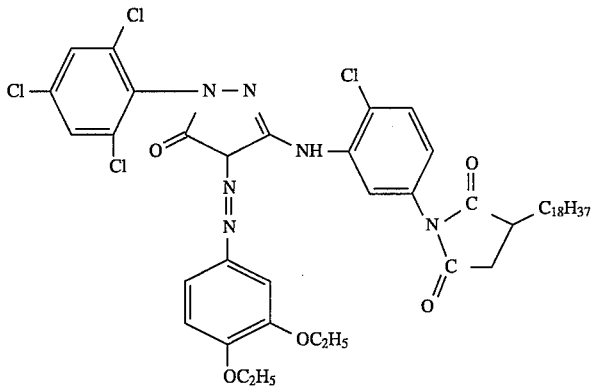
MC-3
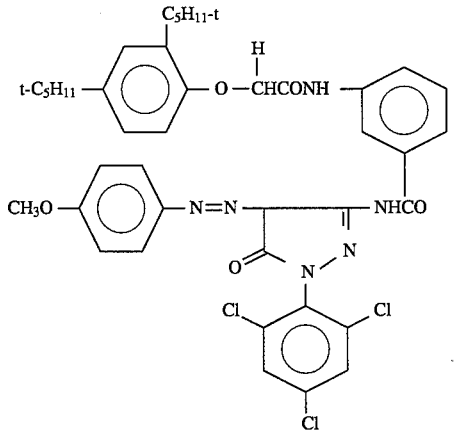
MC-4
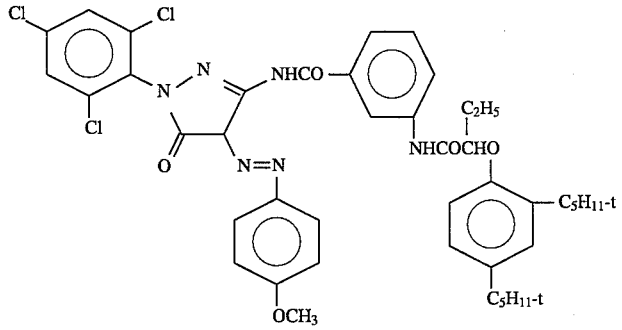
MC-5
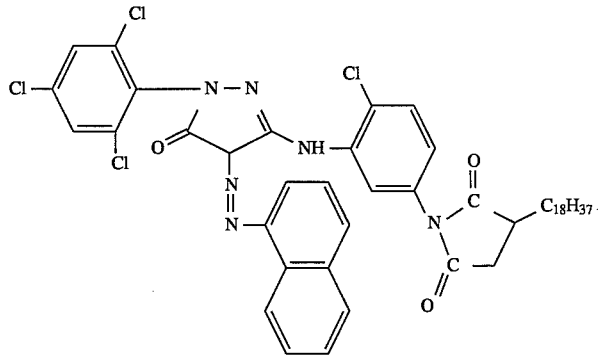

-continued
MC-6
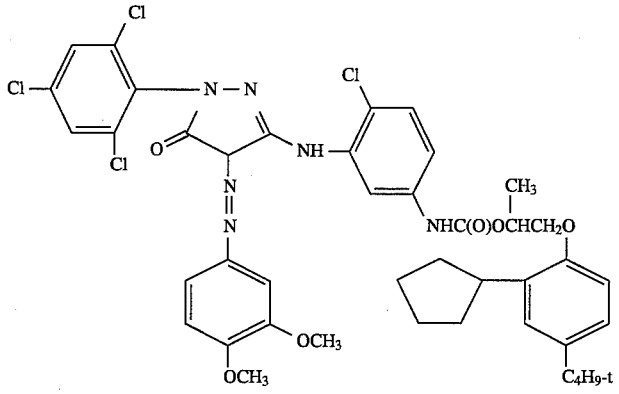
MC-7
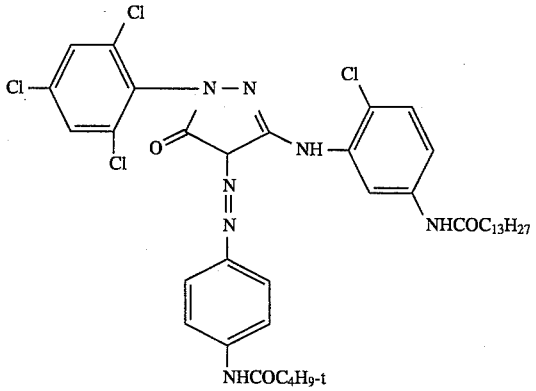
MC-8
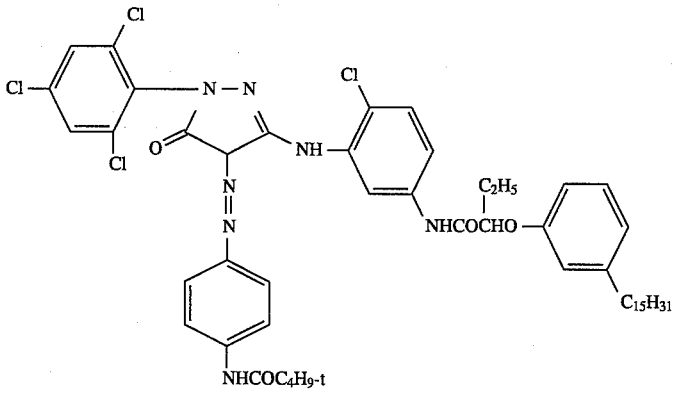
MC-9
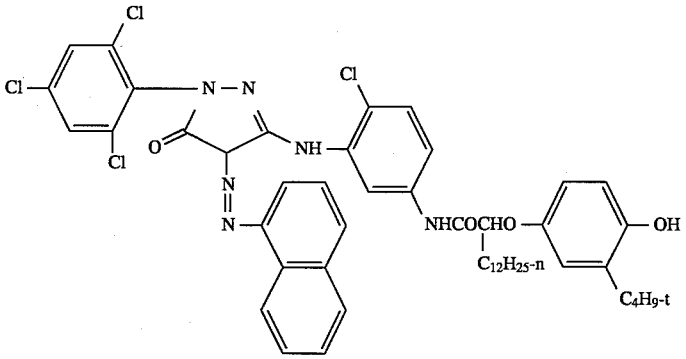

-continued
MC-10
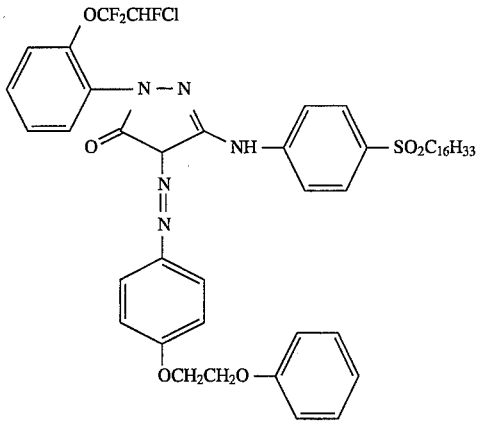
MC-11
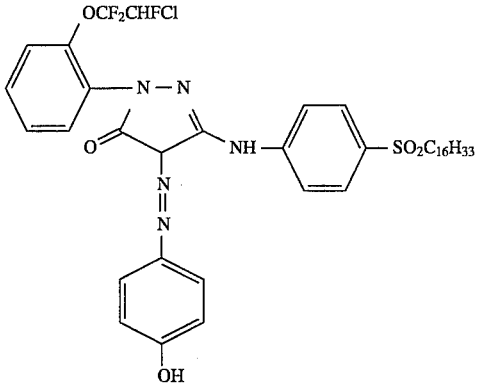
MC-12
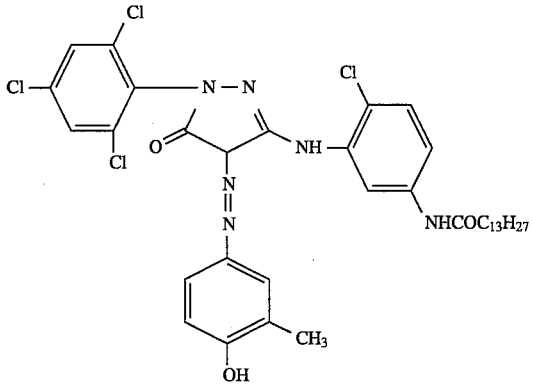
MC-13
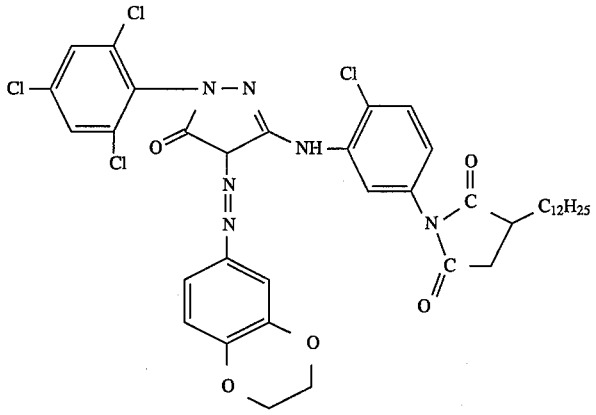

-continued
MC-14
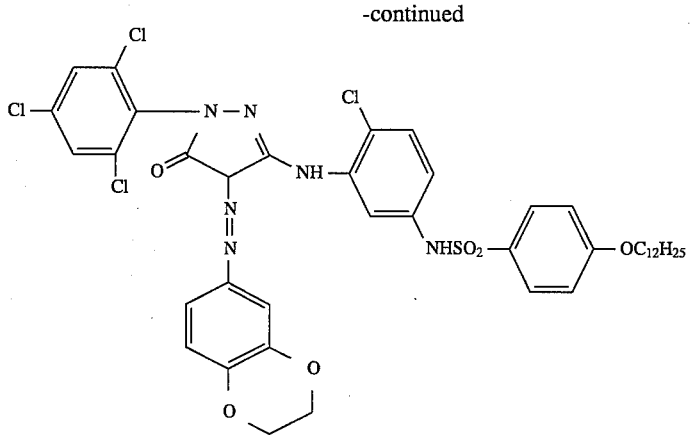
MC-15
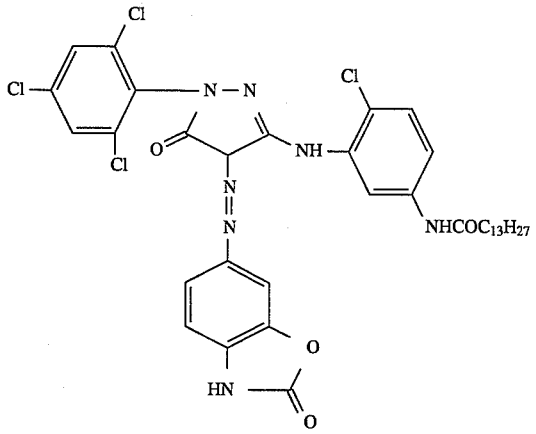
MC-16
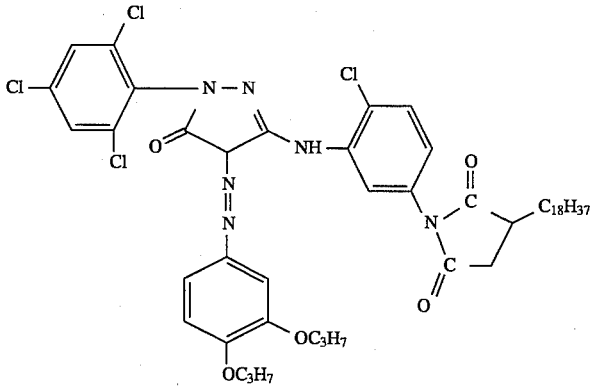
MC-17
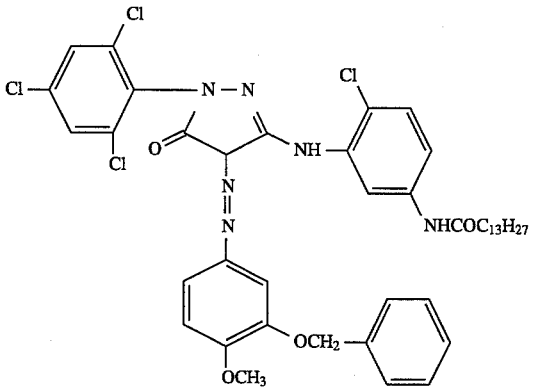

-continued
MC-18
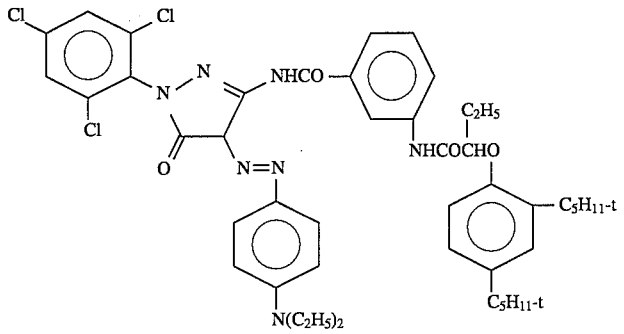
MC-19
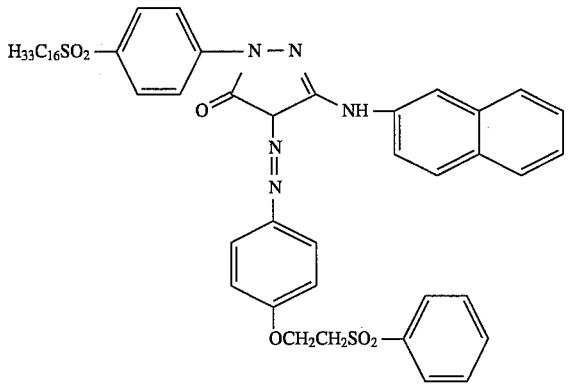
MC-20
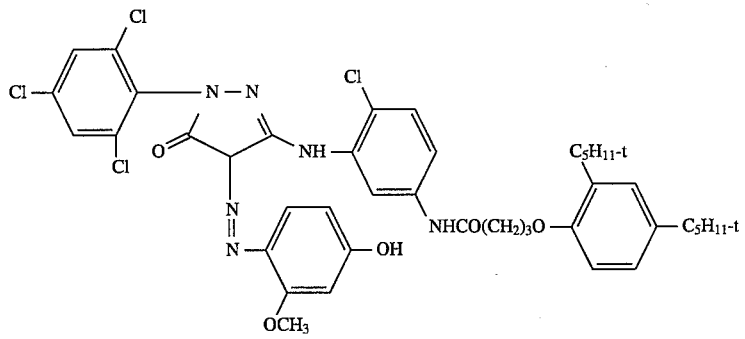
MC-21
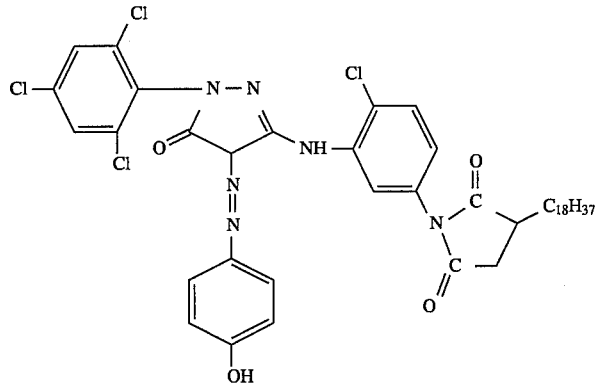

-continued
MC-22
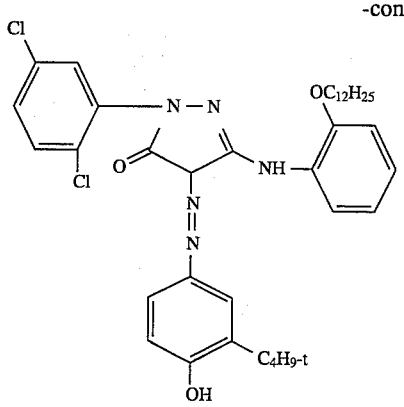
MC-23
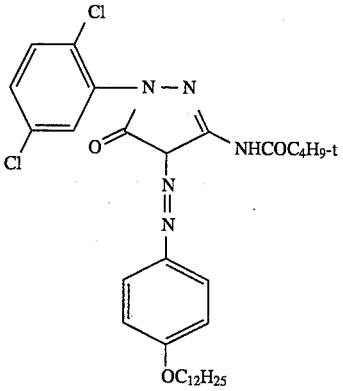
MC-24
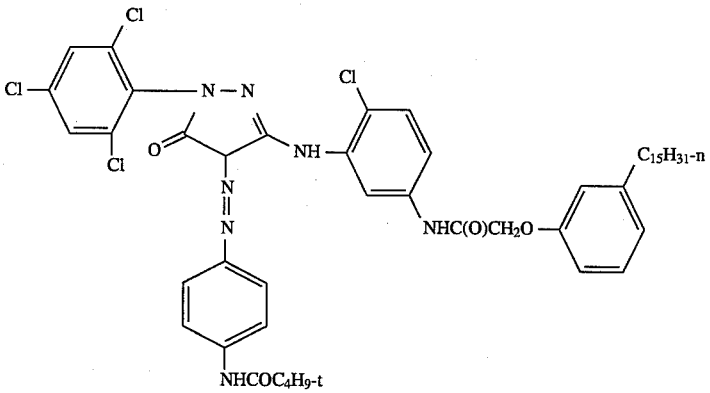
MC-25
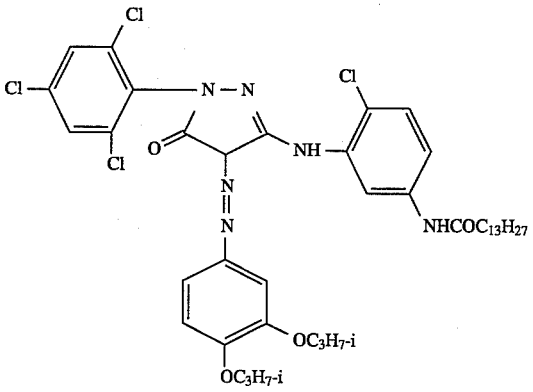

-continued
MC-26
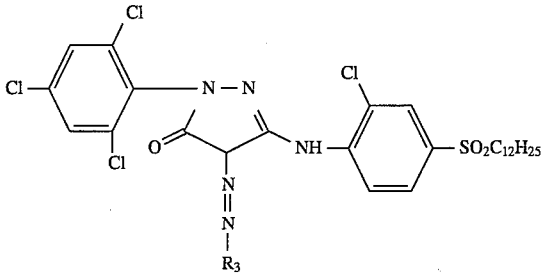
MC-27
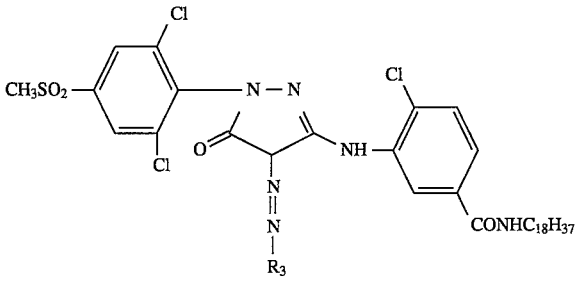
MC-28
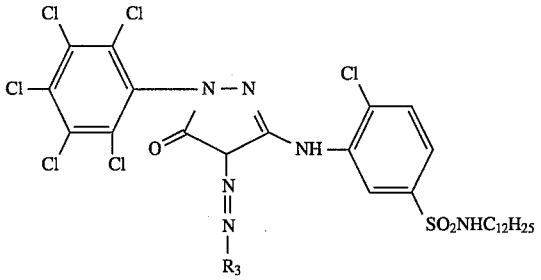
MC-29
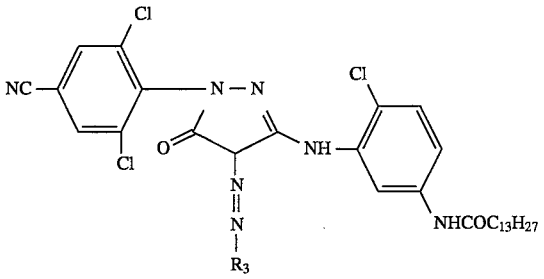
MC-30
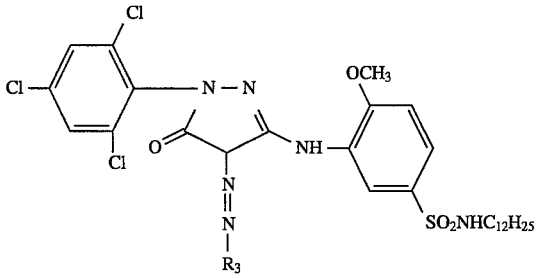
MC-31
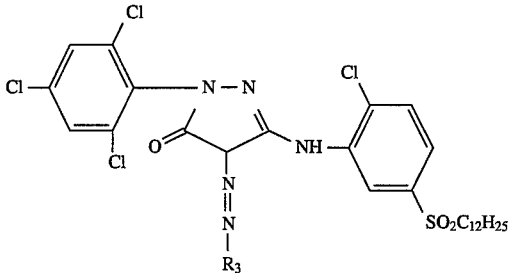

In the last six formulas, $R_3$ can be any one of the following, for example:

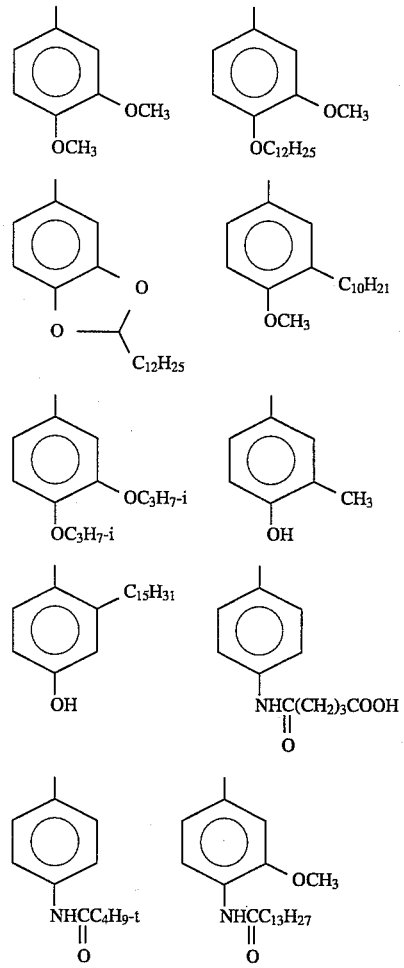

Synthesis of the masking couplers of the invention is well-known and may be generally carried out as more fully described in U.S. Pat. Nos. 2,763,552; 2,801,171; 2,852,370; 3,005,712; 3,519,429; 4,277,559; and Japanese Published Applications 49/123,625; 49/131,448; 52/42121; 52/102,723; 54/52,532; 58/1726; 59/214,853; 61/189,538; 62/50,830; 62/133,458; and 63/104,523.

Examples of substituent groups for the colored masking couplers or bicyclic azole couplers above include: an alkyl group which may be straight or branched, and which may be substituted, such as methyl, ethyl, n-propyl, n-butyl, t-butyl, trifluoromethyl, tridecyl or 3-(2,4-di-t-amylphenoxy)propyl; an alkoxy group, which may be substituted, such as methoxy or ethoxy; an alkylthio group, which may be substituted, such as methylthio or octylthio; an aryl group, an aryloxy group or an arylthio group, each of which may be substituted, such as phenyl, 4-t-butylphenyl, 2,4,6-trimethylphenyl, phenoxy, 2-methylphenoxy, phenylthio or 2-butoxy-5-t-octylphenylthio; a heterocyclic group, a heterocyclic oxy group or a heterocyclic thio group, each of which may be substituted, and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; cyano; an acyloxy group, which may be substituted, such as acetoxy or hexadecanoyloxy; a carbamoyloxy group, which may be substituted, such as N-phenylcarbamoyloxy or N-ethylcarbamoyloxy; a silyloxy group, which may be substituted, such as trimethylsilyloxy; a sulfonyloxy group, which may be substituted, such as dodecylsulfonyloxy; an acylamino or carbonamido group, which may be substituted, such as acetamido or benzamido; an anilino group, which may be substituted, such as phenylanilino or 2-chloroanilino; an ureido, group which may be substituted, such as phenylureido or methylureido; an imido group, which may be substituted, such as N-succinimido or 3-benzylhydantoinyl; a sulfamoylamino group which may be substituted, such as N,N-dipropyl-sulfamoylamino or N-methyl-N-decylsulfamoylamino.

Additional examples of substituent groups include: a carbamoylamino group, which may be substituted, such as N-butylcarbamoylamino or N,N-dimethyl-carbamoylamino; an alkoxycarbonylamino group, which may be substituted, such as methoxycarbonylamino or tetradecyloxycarbonylamino; an aryloxycarbonylamino group, which may be substituted, such as phenoxycarbonylamino or 2,4-di-t-butylphenoxycarbonylamino; a sulfonamido group, which may be substituted, such as methanesulfonamido or hexadecanesulfonamido; a carbamoyl group, which may be substituted, such as N-ethylcarbamoyl or N,N-dibutylcarbamoyl; an acyl group, which may be substituted, such as acetyl or (2,4-di-t-amylphenoxy)acetyl; a sulfamoyl group, which may be substituted such as N-ethylsulfamoyl or N,N-dipropylsulfamoyl; a sulfonyl group, which may be substituted, such as methanesulfonyl or octanesulfonyl; a sulfinyl group, which may be substituted, such as octanesulfinyl or dodecylsulfinyl; an alkoxycarbonyl group, which may be substituted, such as methoxycarbonyl or butyloxycarbonyl; an aryloxycarbonyl group, which may be substituted, such as phenyloxycarbonyl or 3-pentadecyloxycarbonyl; an alkenyl group, which may be substituted; a carboxyl group, which may be substituted; a sulfo group, which may be substituted; hydroxyl; an amino group, which may be substituted.

Substituents for the above substituted groups include halogen, an alkyl group, an aryl group, an aryloxy group, a heterocyclic or a heterocyclic oxy group, cyano, an alkoxy group, an acyloxy group, a carbamoyloxy group, a sityloxy group, a sulfonyloxy group, an acylamino group, an anilino group, a ureido group, an imido group, a sulfonylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, hydroxyl, an amino group or a carbonamido group.

Generally, the above groups and substituents thereof that contain an alkyl group typically include an alkyl group having 1 to 30 carbon atoms. The above groups and substituents thereof that contain an aryl group typically include an aryl group having 6 to 40 carbon atoms, and the above groups and substituents that contain an alkenyl group may include an alkenyl group having 2 to 6 carbon atoms.

Most preferred are chloride, and substituted or unsubstituted sulfamoyl, sulfone, carbamoyl, carboxylic acid, ester, trifluoromethyl, carbonamido, and cyano groups. If desired, these groups may contain a ballast and may be further substituted. One or more electron withdrawing groups may be present.

The third essential component of the invention is an aromatic electron-rich compound. The effect of a substituent on an aromatic ring with regard to electron donating or withdrawing capability has been determined for most common substituents and numeric values representing the relative electron withdrawing effect of substituents on an aromatic ring ("+" for withdrawing; "–" for donating) are provided in *Substituent Constants for Correlation Analysis in Chemistry and Biology* Hansch, C., and Leo, A. J.; Wiley, N.Y., 1979, which provides the Hammett sigma-para values for aromatic ring substituents. When the substituent is one for which a specific Hammett sigma (para) value has not been determined, then the value for the most similar substituent having the same configuration of atoms within three atoms of the ring may be employed as a close approximation. If so desired, an exact determination can be made by experimental determination in accordance with the method referenced by Hansch and Leo. The electron-rich aromatics of this invention are defined as those for which the substituents have Hammett sigma-para values which sum to a total at least as negative as –0.80 and preferably at least as negative as –0.90. Examples of suitable aromatic electron-rich compounds are compounds containing amine or aniline functionalities. Single and fused heterocyclic and hydrocarbyl aromatic rings may be employed with the simple phenyl ring being normally suitable. Some suitable substituents are hydroxy, alkoxy, aryloxy, aryl, thiol, alkylthiol, carbonamido, alkyl, and primary or secondary amines. In a most preferred embodiment, the aromatic also contains a ballast which means one or more substituents containing a hydrophobic group such as alkyl or alkoxy group having a combined total of at least 6 carbon atoms. Specific examples of suitable aromatic compounds, a comparative, and the corresponding sum of Hammett sigma(para) ($\Sigma\sigma_p$) are:

| Compound | $\Sigma\sigma_p$ | Formula |
|---|---|---|
| ER-1 | –0.90 | 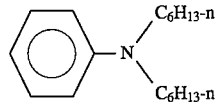 |
| ER-2 | –1.42 | 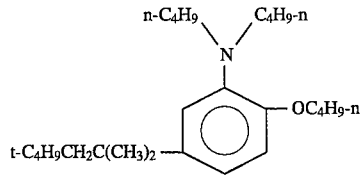 |
| ER-3 | –1.04 | 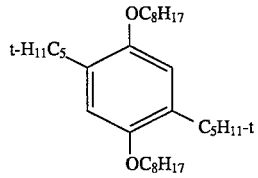 |
| ER-4 | –0.84 | 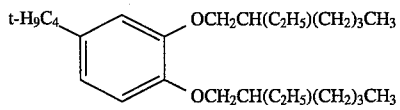 |
| ER-5 | –0.96 | 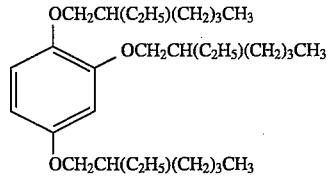 |
| ER-6 | –1.28 | 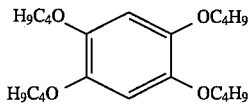 |
| ER-7 | –1.44 | 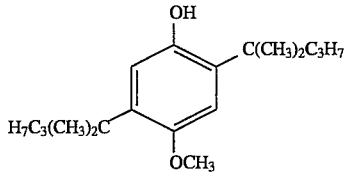 |
| ER-8 | –0.98 | 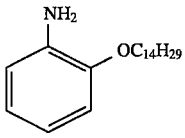 |

-continued

| Compound | $\Sigma\sigma_p$ | Formula |
|---|---|---|
| ER-9 | −0.93 | 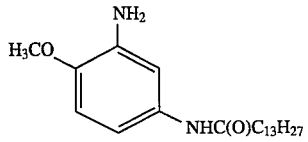 |
| ER-10 | −0.91 | 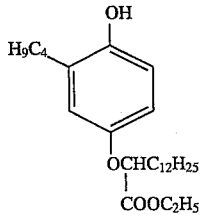 |
| C-1 | −0.77 | 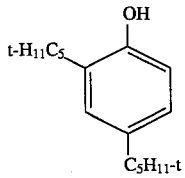 |

Examples of substituent groups for the above include any of those as defined for the bicyclic azole and masking coupler.

If desired two or more of the components of the invention can be codispersed, with or without a coupler solvent. Codispersion refers to the simultaneous dispersion, with or without a solvent, of two or more of the components. Depending on the particular aromatic electron-rich compound employed, it may cofunction as a coupler solvent.

It usually desirable to avoid use of aromatic electron-rich compounds which contain two or more hydroxy groups as ring substituents. Such compounds tend to react with oxidized developer thus decreasing the efficiency of image formation.

The materials of this invention can be used in any of the ways and in any of the combinations in which such materials are used in the photographic art. Typically, they are incorporated in a silver halide emulsion layer and the emulsion layer coated on a support to form part of a photographic element.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a masking coupler of this invention. The element can contain additional layers, such as filter layers, interlayers, overcoat layers, subbing layers, and the like.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido)ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

The materials described herein may be used in combination with other types of couplers such as enamines, 3-acylamino- or 3-anilino-5-pyrazolones and heterocyclic couplers (e.g. pyrazoloazoles) such as those described in EP 285,274; U.S. Pat. No. 4,540,654; EP 119,860, or with other 5-pyrazolone couplers containing different ballasts or coupling-off groups such as those described in U.S. Pat. No. 4,301,235; U.S. Pat. No. 4,853,319 and U.S. Pat. No. 4,351,897. The coupler may also be used in association with yellow or cyan colored couplers (e.g. to adjust levels of interlayer correction) and with other masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

For example, the materials of the invention may be included in a magenta layer or may be added to one or more of the other layers in a color negative photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl]phenyl]thio]-1,3,4-thiadiazol-2-yl]thio]-, methyl ester and "Coupler 3": 1-((dodecyloxy)carbonyl)ethyl-(3-chloro-4-((3-(2-chloro-4-((1-tridecanoylethoxy)carbonyl)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)propyl)amino)carbonyl)-5-hydroxy-1-naphthalenyl)-, 2-methylpropyl ester, "Coupler 7": Acetic acid, ((2-((3-(((3-(dodecyloxy)propyl)amino)carbonyl)-4-hydroxy-8-(((2-methylpropoxy)carbonyl)amino)-1-naphthalenyl)oxy)ethyl)thio)-, and "Coupler 8" Benzamide, 3-((2-(2,4-bis(1,1-dimethylpropyl)phenoxy)-1-oxobutyl)amino)-N-(4,5-dihydro-4-((4-methoxyphenyl)azo)-5-oxo-1-(2,4,6-trichlorophenyl)-1H-pyrazol-3-yl)-; a mid-magenta layer and a slow magenta layer each containing "Coupler 9": 2-Propenoic acid, butyl ester, styrene, 2:1:1 polymer with (N-[1-(2,4,6-trichlorophenyl)-4,5-dihydro-5-oxo-1H-pyrazol-3-yl]-2-methyl-2-propenamide)$_2$ and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy)propyl)amino)carbonyl)-4-hydroxy-1-naphthalenyl)oxy)ethoxy)phenyl)azo)-4-hydroxy-, disodium salt; and a slow cyan layer containing Couplers 2 and 6;

(7) an undercoat layer containing Coupler 8; and (8) an antihalation layer.

The materials may also be used in association with materials that accelerate or otherwise modify the processing steps, e.g. of bleaching or fixing, to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is use of the coupler in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anticolor-mixing agents such as derivatives of hydroquinones, aminophenols, amines, gallic acid; catechol; ascorbic acid; hydrazides; sulfonamidophenols; and noncolor-forming couplers.

The materials may also be used in combination with filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The materials may further be used in combination with image-modifying compounds such as "Developer Inhibitor-Releasing" compounds (DIR's). DIR's useful in conjunction with the couplers of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

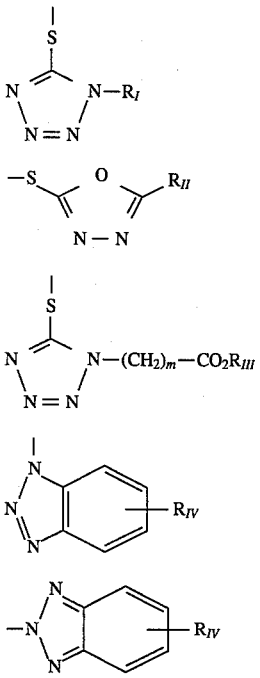

wherein $R_I$ is selected from the group consisting of straight and branched alkyls of from 1 to about 8 carbon atoms, benzyl and phenyl groups and said groups containing at least one alkoxy substituent;

$R_{II}$ is selected from $R_I$ and —$SR_I$;

$R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

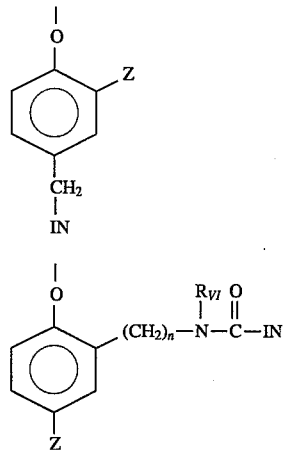

wherein

IN is the inhibitor moiety,

Z is selected from the group consisting of nitro, cyano, alkylsulfonyl; sulfamoyl (—$SO_2NR_2$); and sulfonamido (—$NRSO_2R$) groups;

n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

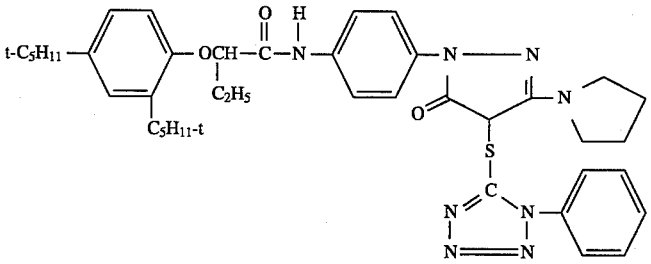

-continued

D2

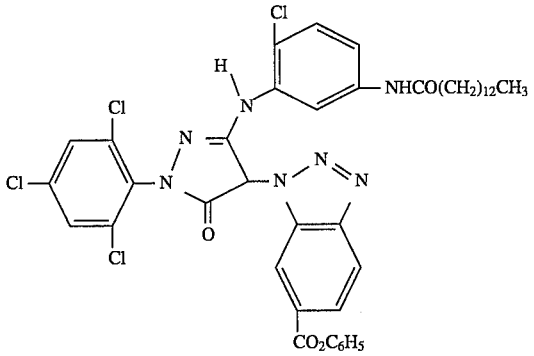

D3

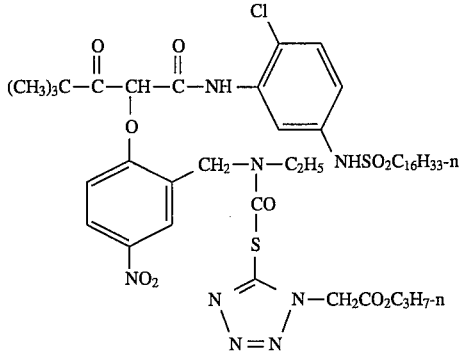

D4

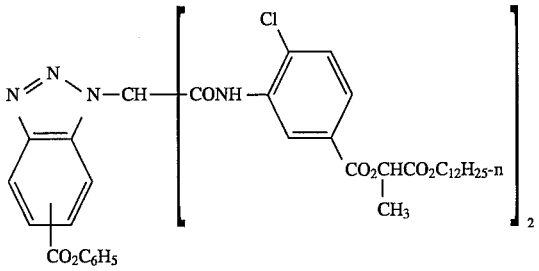

D5

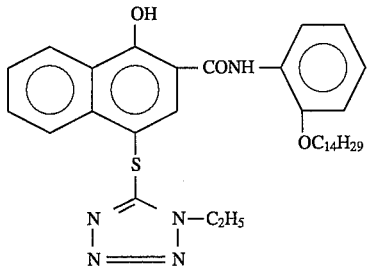

D6

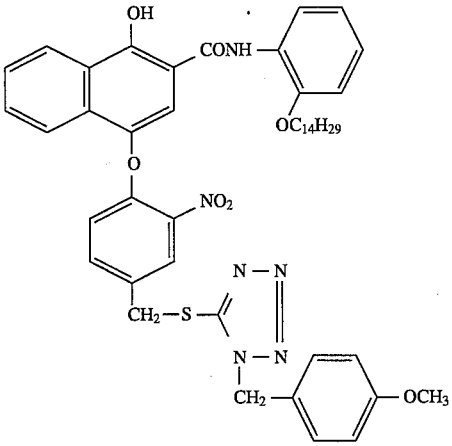

D7

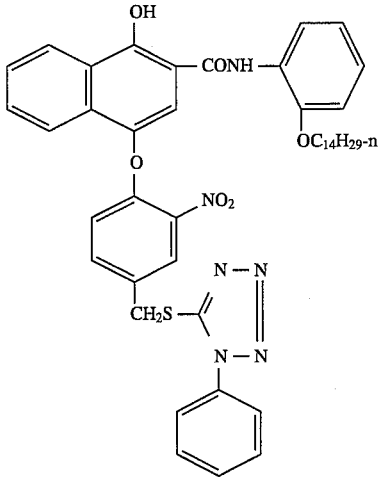

D8

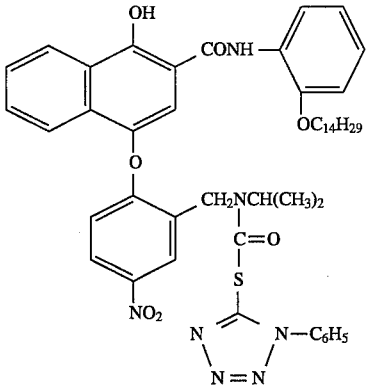

D9

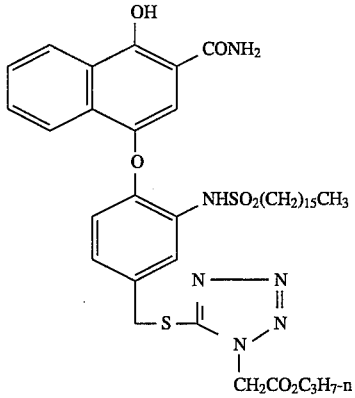

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred to that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure,* Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or internal latent images predominantly in the interior of the silver halide grains. The emulsions can be negative-working emulsions, such as surface-sensitive emulsions or unfogged internal latent image-forming emulsions.

Photographic elements can be exposed to actinic radiation, typically in the visible region of the spectrum, to form a latent image and then processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in, for example, the British Journal of Photography Annual of 1988, pages 191–198.

Development is followed by the conventional steps of bleaching, fixing, or bleach-fixing, to remove silver or silver halide, washing, and drying.

The bicyclic azole, masking, and low impact DIR couplers can be prepared using any of the methods well-known in the art as described, for example, in Section VII of Research Disclosure, and for example in the following patents: European Patent 285,274; PCT published application WO92/12,464; U.S. Pat. Nos. 2,852,370; 3,005,712; 3,725,067; 4,277,559; and 4,540,654.

PHOTOGRAPHIC EXAMPLES AND COMPARISONS

The benefits of the invention can be demonstrated in the following example. A single layer photographic element was prepared by coating a cellulose acetate-butyrate film support with a photosensitive layer containing a green-sensitive silver bromoidodide emulsion at 1.08 g/m$^2$, gelatin at 3.77 g/m$^2$, 0.64 g/m$^2$ of bicyclic azole image coupler M-1 dispersed in half its weight of tritolyphosphate and 0.16 g/m$^2$ of colored masking coupler CM-1 dispersed in twice of its weight of tritolylphosphate. The benefits of the invention are demonstrated by the addition of 0.16 g/m$^2$ of the indicated electron rich aromatic compound dispersed in its own weight of tritolylphosphate. The photosensitive layer was overcoated with a layer containing gelatin at 2.69 g/m$^2$ and was hardened with bis-sulfonyl methyl ether hardener at 1.75 percent based on total gel.

To demonstrate the enhanced raw stock keeping characteriatics of the coatings of the invention, the coatings were kept for a variable amount of time under controlled conditions of temperature and humidity. After keeping, the coatings were exposed through a stepped density test object and processed in accordance with the Kodak Flexicolor (C41) process as described in *British Journal of Photography Annual,* 1988, pp. 196–198, at 37.8° C. employing the following color developing solution, then stopped with a low pH bath, bleached, fixed, washed, and dried to produce stepped colored images.

Color Developing Solution 34.3 g potassium carbonate, anhydrous;

2.32 g potassium bicarbonate;

0.38 g sodium sulfite, anhydrous;

2.78 g sodium metabisulfite;

1.20 mg potassium iodide;

1.31 g sodium bromide;

8.43 g diethylenetriaminepentaacetic acid pentasodium salt (40% soltion);

2.41 g hydroxylamine sulfate;

4.52 g. KODAK Color Developing Agent CD-4; and water to make 1 L, 10.0 pH.

The stabilization of the image coupler to keeping can be seen in the effect of high temperature (48.9° C.) and high humidity (80% relative humidity) for 0, 3 and 7 days. The strips were then exposed and processed, and the loss of image coupler during keeping measured by the change in maximum green density as a function of keeping.

TABLE I

| Image Coupler | Mask | Electron-Rich Aromatic Compound | Type | Green Dmax 0 days | 3 days | 7 days | % Change 7 days |
|---|---|---|---|---|---|---|---|
| M-1 | MC-1 | none | Comp | 2.93 | 2.46 | 2.01 | −31% |
| M-1 | MC-1 | ER-1 | Inv | 3.25 | 3.24 | 3.31 | +2% |
| M-1 | MC-1 | ER-2 | Inv | 3.20 | 3.17 | 3.16 | −1 |
| M-1 | None | None | Comp | 2.95 | 2.96 | 3.00 | +2 |

The maximum dye density of the unstabilized check coating decreases 31% after a seven day incubation. However, coatings containing electron-rich aromatic compounds ER-1 or ER-2 show no image coupler loss for the same incubation period. The final row of the table presents an image coupler-only coating and confirms that the undesired loss of image coupler occurs only in the presence of the azopyrazolone masking coupler.

The loss of image coupler can also be observed in coatings kept under less stringent keeping conditions (37.8° C., 50% humidity) for 7 and 14 days.

TABLE II

| Image Coupler | Mask | Electron-Rich Aromatic Compound | Type | Green Dmax 0 days | 7 days | 14 days | % Change 14 days |
|---|---|---|---|---|---|---|---|
| M-1 | MC-1 | None | Comp. | 2.59 | 2.49 | 2.29 | −11.6 |
| M-1 | MC-1 | ER-1 | Inv. | 3.19 | 3.24 | 3.20 | +0.3 |
| M-1 | MC-1 | ER-2 | Inv. | 3.12 | 3.14 | 3.07 | −1.6 |

The data in Table II shows that the presence of the electron-rich aromatic compounds of the invention serves to eliminate or substantially reduce the degradation of image coupler during keeping. The degradation of image coupler under the above keeping conditions can also be demonstrated by analyzing to determine the amount of image coupler that remains in the coating after keeping using high performance liquid chromotography. Table III shows the results of this determination.

TABLE III

| Image Coupler | Mask | Electron-Rich Aromatic Compound | Type | Image Coupler g/m² 0 days | 14 days |
|---|---|---|---|---|---|
| M-1 | MC-1 | None | Comp. | 0.59 | 0.37 |
| M-1 | MC-1 | ER-1 | Inv. | 0.65 | 0.65 |
| M-1 | MC-1 | ER-2 | Inv. | 0.66 | 0.60 |

The data in Tables II and III shows that the maximum green density after color negative development correlates with the amount of image coupler present in the coating. The inclusion of, electron-rich aromatic compounds in a layer of a photographic element which contains a bicyclic azole image coupler and a azopyrazolone masking coupler results in less degradation of image coupler as a function of keeping.

What is claimed is:

1. A photographic element comprising a light sensitive silver halide layer containing (1) a bicyclic azole coupler, which is a 1H-pyrazolo[3,2-c][1,2,4]-triazole containing a coupling-off group at the coupling position, (2) an azopyrazolone masking coupler, and (3) an aromatic electron-rich compound having ring substituents for which the sum of the individual Hammett sigma-para values is more negative than −0.80, wherein no more than one substituent of the aromatic electron rich compound is hydroxy, and wherein said aromatic electron-rich compound contains at least one alkyl, alkoxy, or amine substituent.

2. The element of claim 1 wherein the sum of the individual Hammett sigma-para value is more negative than −0.90.

3. The element of claim 1 wherein the masking coupler is a phenylazopyrazolone.

4. The element of claim 3 wherein the masking coupler is a para-substituted phenylazopyrazolone.

5. The element of claim 1 wherein the masking coupler is represented by the formula:

$$Cp—N{=}N—R_3$$

wherein,

Cp represents a 5-pyrazolone magenta coupler residual group where the azo group is attached at the 4-position of the magenta coupler, and $R_3$ represents a substituted or unsubstituted aryl group.

6. The element of claim 1 wherein the aromatic electron-rich compound contains at least one alkyl substituent.

7. The element of claim 1 wherein the aromatic compound has a substituted or unsubstituted amine substituent.

8. The element of claim 7 wherein the amine substituent is an N,N-dialkyl substituent.

9. The element of claim 8 wherein the aromatic compound has additional substituents selected from the group consisting of alkyl, alkoxy and hydroxyl.

10. The element of claim 1 wherein the weight ratio of bicyclic azole coupler:masking coupler:aromatic electron-rich compound is 1:0.01 to 100:0.01 to 100.

11. The element of claim 10 wherein the ratio is 1:0.1 to 10:0.1 to 10.

12. The element of claim 1 wherein the aromatic electron-rich compound contains at least one alkoxy substituent.

13. A photographic element comprising a light sensitive silver halide layer containing (1) a bicyclic triazole coupler containing a coupling-off group at the coupling position, (2) an azopyrazolone masking coupler having the formula $$Cp—N{=}N—R_3$$

wherein

Cp represents a 5-pyrazolone magenta coupler residual group which has the formula:

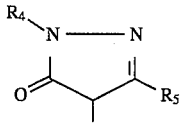

wherein $R_4$ represents a substituted or unsubstituted aryl group, $R_5$ represents a substituted or unsubstituted anilino group, amino group, alkyl group, ureido group or carbamoyl group, and $R_3$ represents a substituted or unsubstituted aryl group, and (3) an aromatic electron-rich compound having ring substituents for which the sum of the individual Hammett sigma-para values is more negative than −0.80 wherein no more than one substituent of the aromatic electron rich compound is hydroxy, and wherein said aromatic electron-rich compound contains at least one alkyl, alkoxy, or amine substituent.

14. The element of claim 13 wherein the bicyclic azole coupler is selected from the group consisting of 1H-pyrazolo [3,2-c][1,2,4]-triazoles and 1H-pyrazolo[1,5-b][1,2,4]-triazoles.

15. The element of claim 14 wherein the bicyclic azole coupler is a 1H-pyrazolo[3,2-c][1,2,4]-triazole.

16. The element of claim 13 wherein the bicyclic azole coupler comprises a parent selected from the group consisting of:

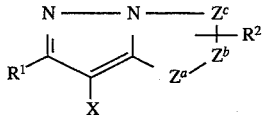

IA and

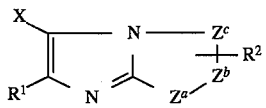

IB wherein $R^1$ and each $R^2$ are independently hydrogen or substituents that do not adversely affect the coupling action of the coupler;

X is hydrogen or a coupling-off group known in the photographic art; and $Z^a$, $Z^b$ and $Z^c$ are independently selected from the group consisting of a substituted or unsubstituted methine group, =N—, =C< or —NH—, provided that one of either the $Z^a$—$Z^b$ bond or the $Z^b$—$Z^c$ bond is a double bond and the other is a single bond.

17. The element of claim 13 wherein the aromatic electron-rich compound contains at least one alkyl substituent.

18. The element of claim 13 wherein the aromatic compound has a substituted or unsubstituted amine substituent.

19. The element of claim 18 wherein the amine substituent is an N,N-dialkyl substituent.

20. The element of claim 19 wherein the aromatic compound has additional substituents selected from the group consisting of alkyl, alkoxy and hydroxyl.

21. The element of claim 13 wherein the weight ratio of bicyclic azole coupler:masking coupler:aromatic electron-rich compound is 1:0.01 to 100:0.01 to 100.

22. The element of claim 13 wherein the aromatic electron-rich compound contains at least one alkoxy substituent.

23. A photographic element comprising a light sensitive silver halide layer containing (1) a bicyclic triazole coupler containing a coupling-off group at the coupling position, (2) an azopyrazolone masking coupler, and (3) an aromatic electron-rich compound having ring substituents for which the sum of the individual Hammett sigma-para values is more negative than −0.80 and wherein no more than one substituent of the aromatic electron-rich compound is hydroxy and wherein said aromatic electron-rich compound contains at least one alkyl, alkoxy, or amine substituent.

24. The element of claim 23 wherein the bicyclic triazole coupler is selected from the group consisting of 1H-pyrazolo [3,2-c][1,2,4]-triazoles and 1H-pyrazolo[1,5-b][1,2,4]-triazoles.

25. The element of claim 24 wherein the bicyclic triazole coupler is a 1H-pyrazolo[3,2-c][1,2,4]-triazole.

26. The element of claim 23 wherein the bicyclic triazole coupler comprises a parent selected from the group consisting of:

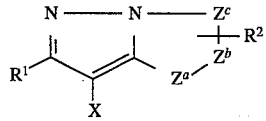

IA and

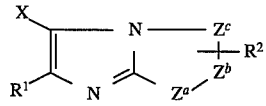

IB wherein $R^1$ and each $R^2$ are independently hydrogen or substituents that do not adversely affect the coupling action of the coupler;

X is hydrogen or a coupling-off group known in the photographic art; and $Z^a$, $Z^b$ and $Z^c$ are independently selected from the group consisting of a substituted or unsubstituted methine group, =N—, =C< or —NH—, provided that one of either the $Z^a$—$Z^b$ bond or the $Z^b$—$Z^c$ bond is a double bond and the other is a single bond, and when the $Z^b$—$Z^c$ bond is a carbon-carbon double bond, it may form part of an aromatic ring.

27. The element of claim 23 wherein the aromatic electron-rich compound contains at least one alkyl substituent.

28. The element of claim 23 wherein the aromatic compound has a substituted or unsubstituted amine substituent.

29. The element of claim 28 wherein the amine substituent is an N,N-dialkyl substituent.

30. The element of claim 29 wherein the aromatic compound has additional substituents selected from the group consisting of alkyl, alkoxy and hydroxyl.

31. The element of claim 23 wherein the weight ratio of bicyclic azole coupler:masking coupler:aromatic electron-rich compound is 1:0.01 to 100:0.01 to 100.

32. The element of claim 23 wherein the aromatic electron-rich compound contains at least one alkoxy substituent.

33. The element of claim 23 wherein at least two of the components (1), (2), and (3) are codispersed.

34. A process for developing an image from an exposed element as defined in claim 23, comprising contacting said exposed element with a color developer.

* * * * *